US008477168B2

(12) United States Patent
Takami et al.

(10) Patent No.: US 8,477,168 B2
(45) Date of Patent: Jul. 2, 2013

(54) RECORDING APPARATUS AND CONTROL METHOD OF RECORDING APPARATUS

(75) Inventors: Toru Takami, Shiojiri (JP); Shingo Todaka, Ueda (JP); Hiroyuki Sakaguchi, Nagano (JP); Takashi Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 281 days.

(21) Appl. No.: 13/075,151

(22) Filed: Mar. 29, 2011

(65) Prior Publication Data

US 2011/0242257 A1 Oct. 6, 2011

(30) Foreign Application Priority Data

Mar. 30, 2010 (JP) ..... 2010-077510

(51) Int. Cl.
*B41J 11/00* (2006.01)

(52) U.S. Cl.
USPC ..... 347/218

(58) Field of Classification Search
USPC ..... 347/171, 218–222
See application file for complete search history.

(56) References Cited

U.S. PATENT DOCUMENTS

| | | | | |
|---|---|---|---|---|
| 5,717,836 | A | 2/1998 | Horie | |
| 5,867,196 | A | 2/1999 | Kiyohara et al. | |
| 6,563,525 | B2 * | 5/2003 | Suzuki | 347/218 |
| 7,315,317 | B2 * | 1/2008 | Kitamura et al. | 347/171 |
| 7,584,951 | B2 | 9/2009 | Otani et al. | |
| 2001/0022609 | A1 * | 9/2001 | Suzuki | 347/218 |
| 2005/0212890 | A1 * | 9/2005 | Kitamura et al. | 347/171 |

FOREIGN PATENT DOCUMENTS

| | | | |
|---|---|---|---|
| EP | 1 698 476 | A1 | 9/2006 |
| JP | 05-162894 | A | 6/1993 |
| JP | 05-238597 | A | 9/1993 |
| JP | 06-000980 | A | 1/1994 |
| JP | 06-016294 | A | 1/1994 |
| JP | 08-040601 | A | 2/1996 |
| JP | 2004-345210 | A | 12/2004 |
| JP | 2008-012815 | A | 1/2008 |
| JP | 2009-107287 | A | 5/2009 |

* cited by examiner

*Primary Examiner* — Kristal Feggins

(57) ABSTRACT

A recording apparatus is provided. A recording head performs recording on a recording medium. A conveyance roller conveys the recording medium in a conveyance direction. A conveyance path includes a curved portion which guides the recording medium and curves the recording medium in a downstream of a nip portion between the recording head and the conveyance roller in the conveyance direction. A discharge portion discharges the recording medium. A detecting unit is located apart from the conveyance path. The detecting unit detects the recording medium which deviates from the conveyance path as the recording medium is drawn into and along the conveyance roller near the curved portion of the conveyance path. A controller rotates the conveyance roller backwards by a predetermined amount to convey the recording medium backwards when the recording medium is detected by the detecting unit, and then rotates the conveyance roller forwards by at least the predetermined amount.

15 Claims, 10 Drawing Sheets

RECORDING APPARATUS AND CONTROL METHOD OF RECORDING APPARATUS

The disclosure of Japanese Patent Application No. 2010-077510 filed on Mar. 30, 2010, including specification, drawings and claims is incorporated herein by reference in its entirety.

BACKGROUND

The present invention relates to a recording apparatus which conveys a recording medium, records an image on the recording medium and discharges the recording medium with the image recorded thereon from a discharge port, and a control method of the recording apparatus.

In general, a recording apparatus, such as a printer or the like, which records characters and/or images on a recording medium, may suffer from a conveyance malfunction such as clogging or being caught of a recording medium during conveyance. Such a conveyance malfunction is generally called a "jam." If a jam occurs in a recording apparatus, the recording apparatus cannot continue to operate and accordingly there is a need to remove a clogged or caught recording medium by hand. There has been proposed a recording apparatus which facilitates such removal work (for example, see Patent Document 1).

[Patent Document 1] JP-A-2009-107287

However, the recording apparatus in which the jam occurs cannot be used until the recording medium is removed by manually. Further, for an apparatus incorporating the recording apparatus, such as an automatic teller machine (ATM) or a ticketing machine, the apparatus as well as the recording apparatus may be stopped due to a jam generated in the recording apparatus, which may result in non-availability of the apparatus. Accordingly, there is a need to minimize a possibility of stoppage of a recording apparatus and an apparatus incorporating the recording apparatus due to a jam generated in the recording apparatus and make stoppage time as short as possible.

SUMMARY

It is therefore an object of at least one embodiment of the present invention to provide a recording apparatus for conveying a recording medium and recording an image on the recording medium, which is capable of minimizing a possibility of stoppage of the recording apparatus due to a jam of the recording medium thereby reducing stoppage time of the recording apparatus.

In order to achieve the above-described object, according to an aspect of the embodiments of the present invention, there is provided a recording apparatus, comprising: a recording head that performs recording on a recording medium; a conveyance roller that conveys the recording medium in a conveyance direction; a conveyance path including a curved portion which guides the recording medium and curves the recording medium in a downstream of a nip portion between the recording head and the conveyance roller in the conveyance direction; a discharge portion that discharges the recording medium; a detecting unit that is located apart from the conveyance path, the detecting unit that detects the recording medium which deviates from the conveyance path as the recording medium is drawn into and along the conveyance roller near the curved portion of the conveyance path; and a controller which rotates the conveyance roller backwards by a predetermined amount to convey the recording medium backwards when the recording medium is detected by the detecting unit, and then rotates the conveyance roller forwards by at least the predetermined amount.

With this configuration, while the recording medium is being conveyed to the conveyance path with the curved portion, if a jam occurs as the recording medium is drawn into the conveyance roller near the curved portion of the conveyance path, the jam is quickly detected by detecting the recording medium deviated from the conveyance path by the detecting unit and the recording medium drawn into the conveyance roller is pulled to the discharge port by rotating the conveyance roller backwards and then forwards, thereby resolving the jam. Accordingly, the jam can be resolved with no manual work by detecting the jam of the recording medium quickly. Accordingly, it is possible to minimize stoppage of the recording apparatus due to the jam of the recording medium and make stoppage time short, which may result in reduced work burden and costs for maintenance and improved availability of the apparatus.

In addition, the recording apparatus is configured to be placed inside an exterior panel accommodating the recording apparatus and to discharge the recording medium through an outlet of the exterior panel which is located outside the discharge port.

With this configuration, for example if the conveyance of the recording medium at the outlet of the exterior panel is disturbed to generate a jam at the curved portion, the jam can be quickly detected to resolve the jam by the backward and forward rotation of the conveyance roller. Accordingly, even when the conveyance of the recording medium is disturbed, the jam is generated at only the curved portion of the conveyance path without generating the jam at portions other than the curved portion and the jam can be resolved by only the backward and forward rotation of the conveyance roller with no manual work in many cases. In addition, when the conveyance of the recording medium is disturbed, generating the jam at the curved portion and drawing the recording medium into the conveyance roller provides the following advantages. For example, if a jam is generated at a different portion of the conveyance path, since the recording medium cannot escape and thus is folded to clog the conveyance path, it is difficult to detect the jam thereby cannot resolve the jam only with the backward and forward rotation of the conveyance roller. However, with the configuration of the present invention, since the jam is mostly generated near the curved portion and accordingly the jammed recording medium arrives at a predetermined position of the conveyance roller, the jam can be easily detected, the recording medium will not be folded to clog the conveyance path, wrinkling of the recording medium is minute by the time the jam is detected, and the jam can be resolved with the backward and forward rotation of the conveyance roller. Accordingly, it is possible to minimize the stoppage of the apparatus due to the jam of the recording medium and make stoppage time short. In addition, there is no need to open the exterior panel to resolve the jam of the recording apparatus accommodated in the exterior panel, which may result in reduced work burden and costs for maintenance and improved availability of the apparatus.

In the recording apparatus, the detecting unit may be disposed so as to detect the recording medium at a position facing a circumference of the conveyance roller, and a distance along the circumference of the conveyance roller from the nip portion to a detection position of the detecting unit may be shorter than at least a distance from the curved portion of the conveyance path to the discharge port.

With this configuration, the recording medium which is curved at the curved portion of the conveyance path and drawn into the conveyance roller can be detected by the detecting unit. In addition, since the jam can be detected before a portion including the leading end of the recording medium conveyed below the curved portion gets drawn into the conveyance roller, the leading end of the recording medium can be guided and proceed to the discharge port along the conveyance path as the conveyance is stopped and the conveyance roller is rotated backwards and then forwards with the leading end of the recording medium staying on the conveyance path. If the leading end of the recording medium deviates from the conveyance path, it is difficult to move the leading end of the recording medium to the discharge port along the conveyance path even when the conveyance roller is rotated backwards and forwards; however, the recording apparatus of the present invention can avoid such a difficult situation. In this manner, a jam can be efficiently resolved by the operation of the conveyance roller after the detection.

In the recording apparatus, the conveyance roller may be a platen which is disposed so as to face the recording head and conveys the recording medium interposed between the platen and the recording head when performing the recording on the recording medium.

With this configuration, if the recording medium conveyed by the platen is jammed, the jam can be resolved by the operation of the platen with no manual work.

In the recording apparatus, the recording apparatus may include a body and a front frame, the front frame may be rotatably attached to the body, the body may be provided with at least the recording head, and the front frame may be provided with at least the platen.

Even if the jam is not resolved, since the front frame can be opened to open a space between the recording head and the conveyance roller, the jam can be easily eliminated.

In the recording apparatus, the platen may be movable between a normal position facing the recording head and a deviation position at a side of the discharge port, a projection having an inclined plane which contacts the platen and guides the platen to the normal position when the platen is moved from the deviation position to the normal position may be provided at a side of the recording head, and the projection may project toward the conveyance path to form the curved portion.

With this configuration, the projection projecting toward the conveyance path is provided to include the inclined plane which smoothly guides the platen after contacting the platen such that the platen does not collide with the recording head while the platen is returned to the normal position, and the recording medium is conveyed over the projection. Accordingly, it is possible to quickly detect and resolve a jam which may occur as the recording medium is folded when the recording medium passes beyond the projection. In addition, as the platen is moved with deviation and the conveyance path of the recording medium is opened, it is possible to facilitate setting of the recording medium and removal of the recording medium with a jam unresolved.

The recording apparatus may further comprise a recording head supporting unit that supports the recording head, and the curved portion may be integrally formed in the recording head supporting portion.

The projection can be configured to integrate the inclined plane guiding the platen with the curved portion which may serve as the cause of the jam, which is effective for compactness of the apparatus.

In the recording apparatus, the controller may rotate the conveyance roller backwards when the detecting unit detects the recording medium, and then convey the recording medium at a speed which is lower than a speed at which the recording medium is conveyed during or after performing the recording on the recording medium.

With this configuration, since the recording medium is conveyed to the discharge port at a low speed while resolving a jam by rotating the conveyance roller backwards, the recording medium is conveyed to allow it to be easily discharged from the discharge port, thereby preventing a recurrence of jam during conveyance to resolve the jam more reliably.

In the recording apparatus, the detecting unit may be located in the center of the width direction of the conveyance roller.

With this configuration, it is possible to quickly detect a jam for the recording medium having different widths.

The recording apparatus may further comprise a notifying unit that notifies that the recording medium is detected when the detecting unit detects the recording unit after the controller rotates the conveyance roller backwards and forwards at least once.

With this configuration, if a jam is still detected even with at least one or more repeated backward and forward rotations of the conveyance roller, it is determined that the jam cannot be resolved and the operator is notified of an error. In this case, a buzzer or other indicating means prompts notifies the error to a operator and the operator to remove the jam by hand. This notification allows the operator to move the platen to remove the jammed recording medium easily.

In the recording apparatus, the predetermined amount by which the conveyance roller is rotated backwards may be set such that a leading end of the recording medium is located in the downstream of the nip portion or the curved portion in the conveyance direction after the conveyance roller is rotated backwards by the predetermined amount.

This configuration prevents the recording medium from deviating from the conveyance path.

The recording apparatus may further comprise a cutter disposed in the downstream of the recording head in the conveyance direction, the cutter that cuts the recording medium at a cutting position, and a distance along a circumference of the conveyance roller from the nip portion to a detection position of the detecting unit may be shorter that at least a distance from the cutting position of the cutter to the discharge port.

This configuration prevents the recording medium from being caught by the cutter when the recording medium is conveyed backwards and forwards.

According to another aspect of the embodiments of the present invention, there is provided a control method of a recording apparatus which comprises: a recording head that performs recording on a recording medium; a conveyance roller that conveys the recording medium in a conveyance direction; a conveyance path including a curved portion which guides the recording medium and curves the recording medium in a downstream of a nip portion between the recording head and the conveyance roller in the conveyance direction; a discharge portion that discharges the recording medium; and a detecting unit that is located apart from the conveyance path, the detecting unit that detects the recording medium which deviates from the conveyance path as the recording medium is drawn into and along the conveyance roller near the curved portion of the conveyance path, the control method comprising: rotating the conveyance roller backwards by a predetermined amount to convey the recording medium backwards when the recording medium is detected by the detecting unit, and then rotating the conveyance roller forwards by at least the predetermined amount.

With this configuration, while the recording medium is being conveyed to the conveyance path with the curved portion, if a jam occurs as the recording medium is drawn into the conveyance roller near the curved portion of the conveyance path, the jam is quickly detected by detecting the recording medium deviated from the conveyance path by the detecting unit and the recording medium is pulled to the discharge port by rotating the conveyance roller backwards and then forwards, thereby resolving the jam. Accordingly, the jam of the recording medium drawn into the conveyance roller can be resolved with no manual work by detecting the jam quickly. Accordingly, it is possible to minimize stoppage of the recording apparatus due to the jam of the recording medium and make stoppage time short, which may result in reduced work burden and costs for maintenance and improved availability of the apparatus.

The control method may further comprise determining that a jam is generated if the detecting unit detects the recording medium.

The control method may further comprise determining that the jam is not resolved if the detecting unit detects the recording unit after rotating the conveyance roller backwards and forwards at least once.

The control method may further comprise conveying the recording medium at a speed which is lower than a speed at which the recording medium is conveyed during or after performing the recording on the recording medium, when rotating the conveyance roller forwards after rotating the conveyance roller backwards as the recording medium is detected by the detecting unit.

In the control method, the predetermined amount by which the conveyance roller is rotated backwards may be set such that a leading end of the recording medium is located in the downstream of the nip portion or the curved portion in the conveyance direction after the conveyance roller is rotated backwards by the predetermined amount.

According to the present invention, a jam of a recording medium can be resolved with no manual work by detecting the jam quickly. Accordingly, it is possible to minimize stoppage of the recording apparatus due to the jam of the recording medium and make stoppage time short.

DETAILED DESCRIPTION OF THE EMBODIMENTS

Hereinafter, embodiments of the present invention will be described with reference to the drawings.

Figure 1:
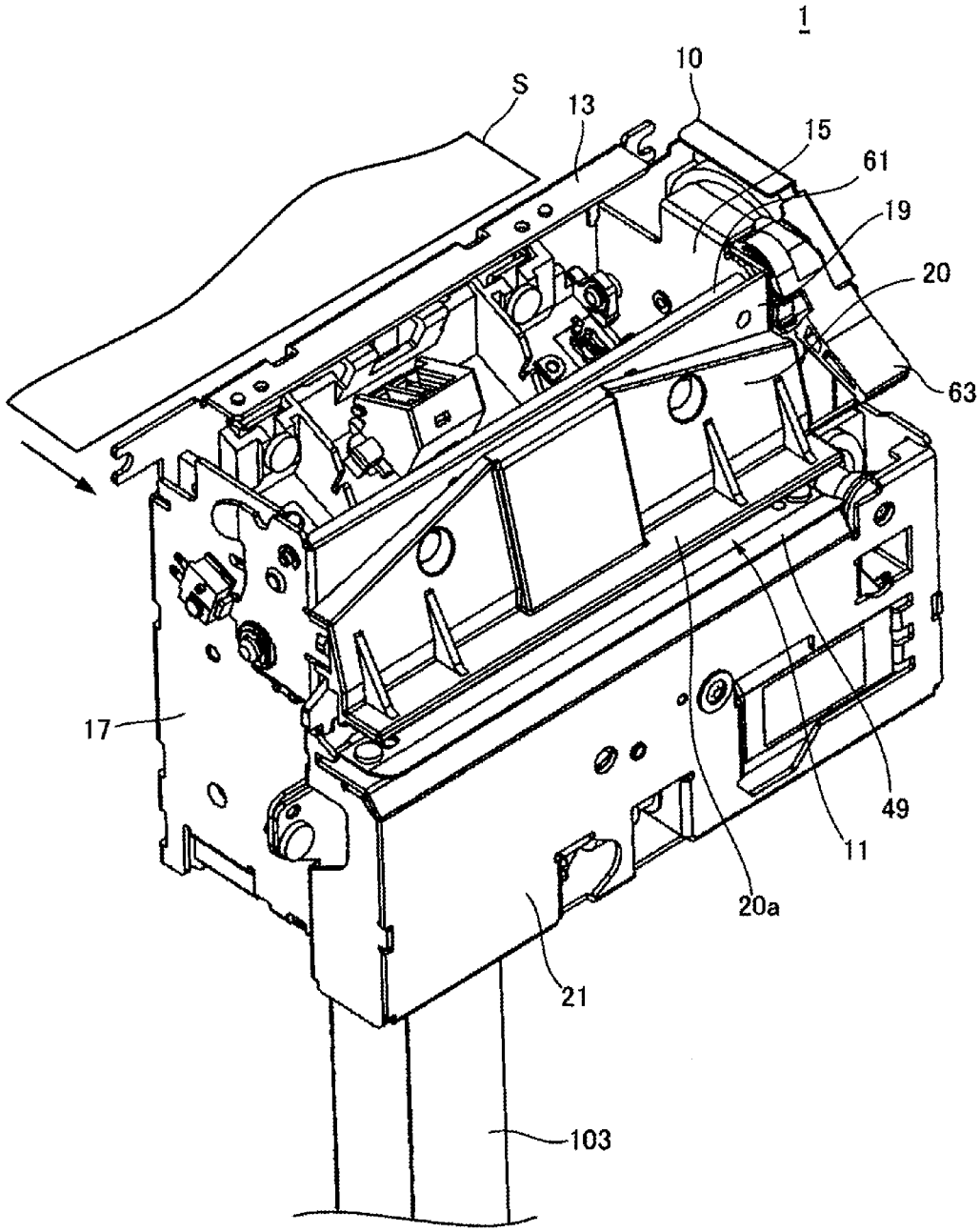
FIG. 1 is a perspective view of a printer according to an embodiment of the present invention.
Figure 2:
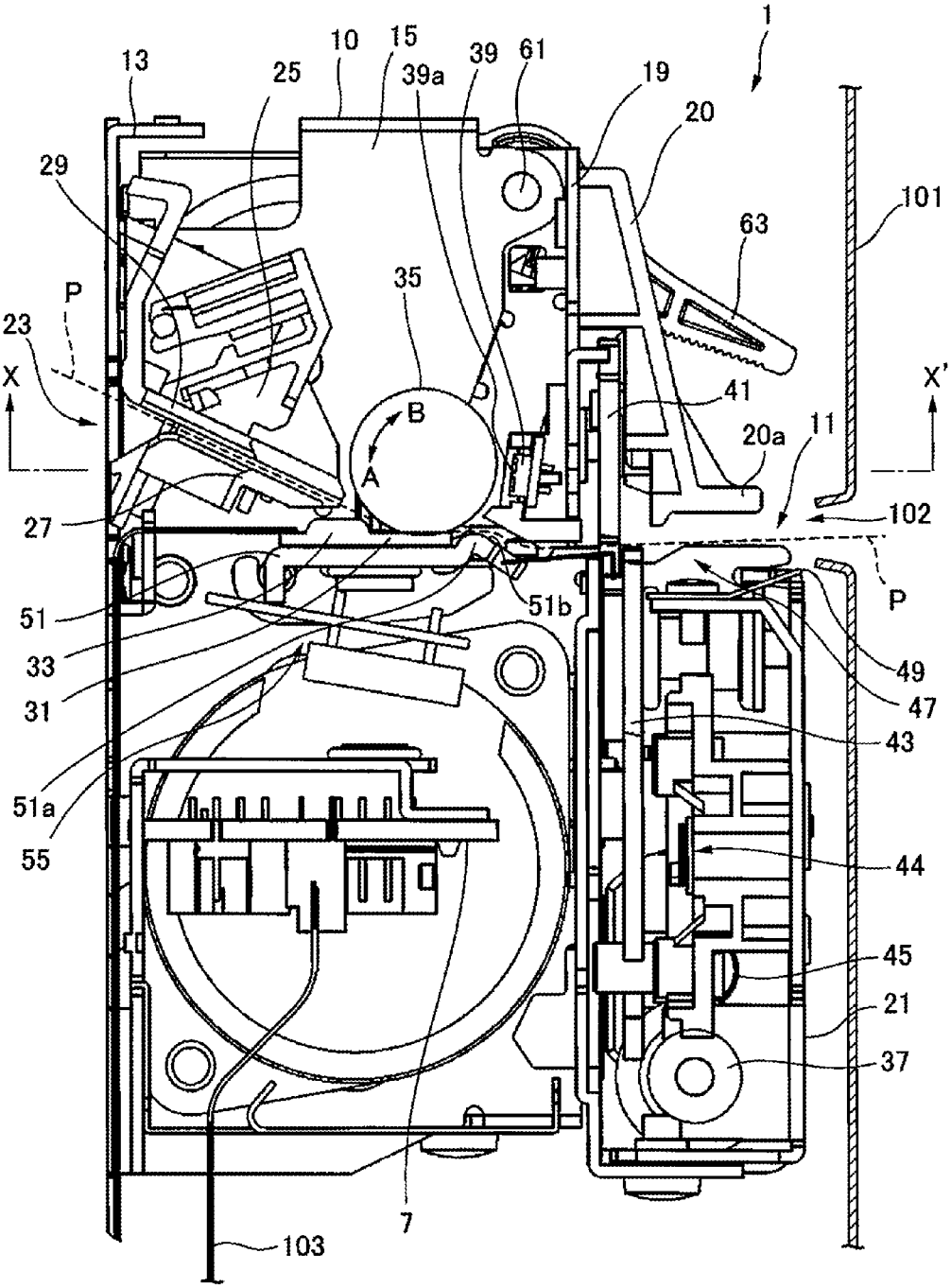
FIG. 2 is a sectional view showing an installation state of a printer.

FIG. 1 is a perspective view of a printer 1 according to an embodiment of the present invention. FIG. 2 is a sectional view showing an installation state of the printer 1.

The printer 1 is a recording apparatus which prints (records) characters, symbols, images, etc. on a heat-sensitive roll paper S, which is a recording medium which is fed from the rear side of a body 10, by applying thermal energy to the heat-sensitive roll paper S, and then discharges the heat-sensitive roll paper S through a discharge port 11 provided in the front side of the body 10.

The printer 1 is a built-in apparatus which is incorporated in an apparatus (not shown) such as, for example, a vending machine with a payment function, and issues various kinds of business forms such as receipts, tickets and the like. As shown in FIG. 2, the printer 1 is provided inside an exterior panel 101 forming a housing of the apparatus and the heat-sensitive roll paper S discharged through the discharge port 11 from the printer 1 is discharged through an outlet 102 formed in the exterior panel 101.

The printer 1 is fixed, along with the heat-sensitive roll paper S, within the apparatus and is connected to a control circuit of the apparatus via a flexible cable 103. The printer 1 is input, via the flexible cable 103, with control information, including data of characters and images to be printed on the heat-sensitive roll paper S, commands to instruct the printer 1 to operate, etc., and is supplied with power to operate various components of the printer 1.

As shown in FIG. 1, the body 10 of the printer 1 is configured to include various components in a body frame which is constituted by a base frame 13, a right side frame 15 and a left side frame 17. A front frame 19 is mounted on the front top of the body 10 in such a manner that the front frame 19 can be rotated with respect to the left and right side frames 15 and 17, and a top cover 20 is disposed to cover the front side of the front frame 19. In addition, a cutter unit case 21 is provided at the front bottom of the body 10, and the discharge port 11 is opened between the top cover 20 and the cutter unit case 21.

As shown in FIG. 2, an insertion slot 23 which introduces the heat-sensitive roll paper S is opened on the rear side of the body 10, a lower paper guide 27 and an upper paper guide 29 which guide the heat-sensitive roll paper S introduced from the insertion slot 23 in an inclined downward direction are provided in a back portion of the body 10, and a paper detecting sensor 25 is provided in the upper paper guide 29. The paper detecting sensor 25 is a reflective optical sensor which irradiates the lower paper guide 27 with light to detect reflected light, and can detect the presence or absence of the heat-sensitive roll paper S located on the lower paper guide 27 based on a detection state of a light receiving portion of the paper detecting sensor 25.

Front ends of the lower paper guide 27 and the upper paper guide 29 confront a recording head 31 which is substantially horizontally placed. The recording head 31 is a line thermal head having a plurality of heating elements which contact a recording surface (corresponding to the bottom side in FIG. 2) of the heat-sensitive roll paper S and are arranged in a line. The recording head 31 is integrated with a head driver circuit 33 which supplies a driving current to the line thermal head. In addition, a platen 35 is placed to face the recording head 31 and the heat-sensitive roll paper S is interposed between the platen 35 and the recording head 31.

The platen 35 (or a conveyance roller) is a roller platen which extends in the width direction of the body 10 and is rotatably supported to the front frame 19. The platen 35 is driven to be rotated by a conveyance motor 37 and conveys the heat-sensitive roll paper S with the heat-sensitive roll paper S interposed between the platen 35 and the recording head 31. Based on a rotation direction of the conveyance motor 37, the platen 35 alternates between a forward rotation indicated by a symbol A in the figure and a backward rotation indicated by a symbol B in the figure. When the platen 35 is rotated forwards, the heat-sensitive roll paper S is conveyed forwards toward the discharge port 11. When the platen 35 is rotated backwards, the heat-sensitive roll paper S is conveyed backwards toward the insertion slot 23.

The heat-sensitive roll paper S introduced into the body 10 through the insertion slot 23 is guided between the recording head 31 and the platen 35 after passing between the lower paper guide 27 and the upper paper guide 29 and is conveyed to the discharge port 11 as the platen 35 is rotated. A conveyance path of the heat-sensitive roll paper S is denoted by a symbol P in the figure.

In the front side of the recording head 31 and the platen 35 are arranged a fixed blade 41 and a movable blade 43 (cutter) which cut the heat-sensitive roll paper S. The fixed blade 41 is fixed to the front frame 19 of the body 10 and the movable blade 43 is built in the cutter unit case 21 located below the front frame 19. The fixed blade 41 and the movable blade 43 face with each other in a vertical direction with the conveyance path P of the heat-sensitive roll paper S interposed therebetween. The movable blade 43 is driven vertically by a cutter driving motor 45 built in the cutter unit case 21 and a driving mechanism 44 connecting the conveyance motor 37 and the movable blade 43. The heat-sensitive roll paper S is cut as the movable blade 43 is ascended to engage the fixed blade 41. The fixed blade 41, the movable blade 43, the driving mechanism 44 and the cutter driving motor 45 constitute a cutter unit 47.

The fixed blade 41 is fixed to the front frame 19 and its front side is covered by the top cover 20 for the purpose of safety. The front end of the top cover 20 is configured as a front upper paper guide 20*a* stretched over the discharge port 11. In addition, a front lower paper guide plate 49 slightly extending over a level is attached above the cutter unit case 21. The heat-sensitive roll paper S get out of the discharge port 11 is guided to the outlet 102 by the front lower paper guide plate 49 and the front upper paper guide 20*a*.

The heat-sensitive roll paper S printed by the recording head 31 is conveyed to the discharge port 11 by the platen 35 and is cut by the cutter unit 47 at a position at which the leading end of the heat-sensitive roll paper S projects over the outlet 102 located in the front side of the discharge port 11. The cut heat-sensitive roll paper S comes out of the outlet 102 to allow a user to pluck it out.

The body 10 further includes a biasing mechanism 55 which biases the recording head 31 toward the platen 35. A head supporting plate 51 contacts from below the recording head 31 which is substantially of a flat-plate shape, and the biasing mechanism 55 makes close contact between the recording head 31 and the platen 35 by pushing the head supporting plate 51, along with the recording head 31, up using an elastic leaf spring fixed to the left and right side frames 15 and 17. The recording head 31 is pressed against the platen 35 by a biasing force of the biasing mechanism 55 and a pressing force to interpose the heat-sensitive roll paper S is exerted on a nip between the recording head 31 and the platen 35. By this pressing force facilitates close adhesion between the recording head 31 and the heat-sensitive roll paper S for higher quality printing and prevents the platen 35 and the heat-sensitive roll paper S from sliding, thereby providing a correct conveyance.

A projection 51*a* is provided in the front end of the head supporting plate 51. The projection 51*a* is a mountain-like convex portion formed by bending the front portion of the head supporting plate 51 and projects from below toward the conveyance path P. The projection 51*a* is provided to maintain the platen 35 in correct place to ensure that the biasing force of the biasing mechanism 55 is transferred to the recording head 31 and the platen 35.

The front frame 19 of the body 10 is rotatably supported by a round bar-like shaft 61 spanning over the left and right side frames 15 and 17 and may be forwards opened around the shaft 61. As shown in FIGS. 1 and 2, a fixed lever 63 attached in a manner to be rotated around the shaft 61 along with the front frame 19 is provided in the front portion of the right side frame 15. The fixed lever 63 engages the front frame 19 at a bottom position of a rotation range and fixes the front frame 19 to the right side frame 15. When the fixed lever 63 is rotated to rise up, the engagement of the fixed lever 63 with the front frame 19 is released so that the front frame 19 can be rotated forwards.

Figure 3:
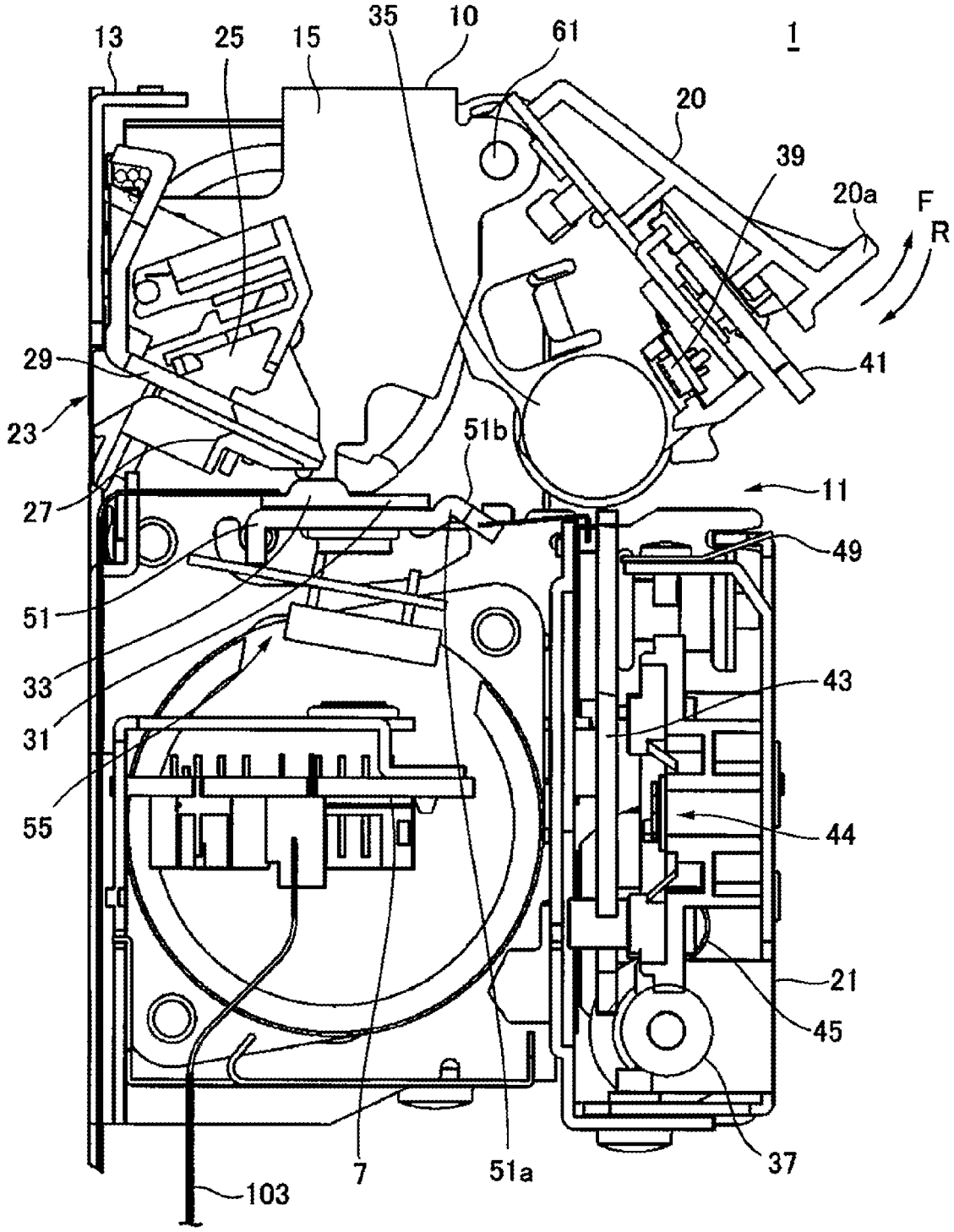
FIG. 3 is a sectional view of a printer with its front frame opened.

FIG. 3 is a sectional view of the printer with the front frame 19 forwards opened.

As indicated by an arrow F in FIG. 3, when the front frame 19 is rotated forwards, the platen 35 and the fixed blade 41 are forwards moved along with the front frame 19. Under such an open state, since the platen 35 becomes far away from the recording head 31, a retention force exerted on the heat-sensitive roll paper S disappears to facilitate removal, setting, exchange or the like of the heat-sensitive roll paper S. After completion of exchange or the like of the heat-sensitive roll paper S, the front frame 19 is rotated in a direction indicated by an arrow R in FIG. 3 and the platen 35 is accommodated in a position opposing the recording head 31.

In a normal state where the printer perform a print operation, the recording head 31 and platen 35 are pressed by the biasing force of the biasing mechanism 55, and, when the front frame 19 is forwards opened, the platen 35 deviates from its normal position and the recording head 31 is moved to the uppermost of a movable range, along with the head supporting plate 51. In the course of returning the front frame 19 from its open state to its normal state, there arises a need to push the recording head 31 down to allow the platen 35 to be accommodated by the biasing force of the biasing mechanism 55. In order to prevent the platen 35 from making direction collision with the heating elements of the recording head 31 in this course, the printer 1 includes the projection 51*a* in the front portion of the head supporting plate 51. Since the projection 51*a* is a mountain-like projection located in the front of the recording head 31 and has an inclined plane 51*b* in its front side, the platen 35 contacts the inclined plane 51*b* in its front side of the projection 51*a* when the platen 35 is moved in the direction indicated by the arrow R from the state shown in FIG. 3. From this state, when the platen 35 is moved in the direction indicated by the arrow R while being guided to the inclined plane 51*b*, the platen 35 resists the biasing force of the biasing mechanism 55 to push the recording head 31 and the head supporting plate 51 down, and accordingly the platen 35 extends beyond the projection 51*a* to return to its normal position opposing the recording head 31.

In this manner, the body 10 is configured such that the platen 35 and the recording head 31 are closely adhered to each other by the biasing force in the normal state and the close adhesion between the recording head 31 and the platen 35 is released by forwards moving the platen 35 for exchange of the heat-sensitive roll paper S. In this configuration, the projection 51*a* is provided to prevent the platen 35 from colliding with the recording head 31 when the platen 35 is returned to its normal state.

For this reason, it is essential for the projection 51*a* to have a shape projecting toward the conveyance path P such that the projection 51*a* contacts the platen 35 when the platen 35 is returned to its normal state, and the heat-sensitive roll paper S conveyed by the platen 35 proceeds to the discharge port 11 beyond the projection 51*a*. That is, the conveyance path P along which the heat-sensitive roll paper S is conveyed is curved upwardly in the projection 51*a* and the heat-sensitive roll paper S is then conveyed along this curved conveyance path P.

In addition, since the head driver circuit 33 having a shape rising over the recording head 31 is located in the rear of the recording head 31, the platen 35 is prevented from deviating from its normal position due to the head driver circuit 33 and the projection 51*a*.

The projection 51*a* and the inclined plane 51*b* can be integrated with the head supporting plate 51, which may contribute to reduced space and compactness.

The printer 1 as configured above includes a jam detecting sensor 39 (detector) which detects a jam if the heat-sensitive roll paper S conveyed by the platen 35 is clogged (or jammed) in the front of the discharge port 11.

As shown in FIGS. 2 and 3, the jam detecting sensor 39 is located in the front of the platen 35 to face the circumference of the platen 35. The jam detecting sensor 39 is a reflective optical sensor and has a detecting surface 39*a* on which a light emitting section (not shown) and a light receiving section (not shown) are formed. Based on a light receiving state of the jam detecting sensor 39, it may be detected whether or not the heat-sensitive roll paper S is present on the circumference of the platen 35 facing the jam detecting sensor 39.

As can be clearly seen from FIG. 2, the jam detecting sensor 39 is located above the conveyance path P. That is, the jam detecting sensor 39 is a sensor which detects if a jam occurs and the heat-sensitive roll paper S gets drawn above the conveyance path P by the platen 35 rotating in a direction indicated by an arrow A.

Figure 4:
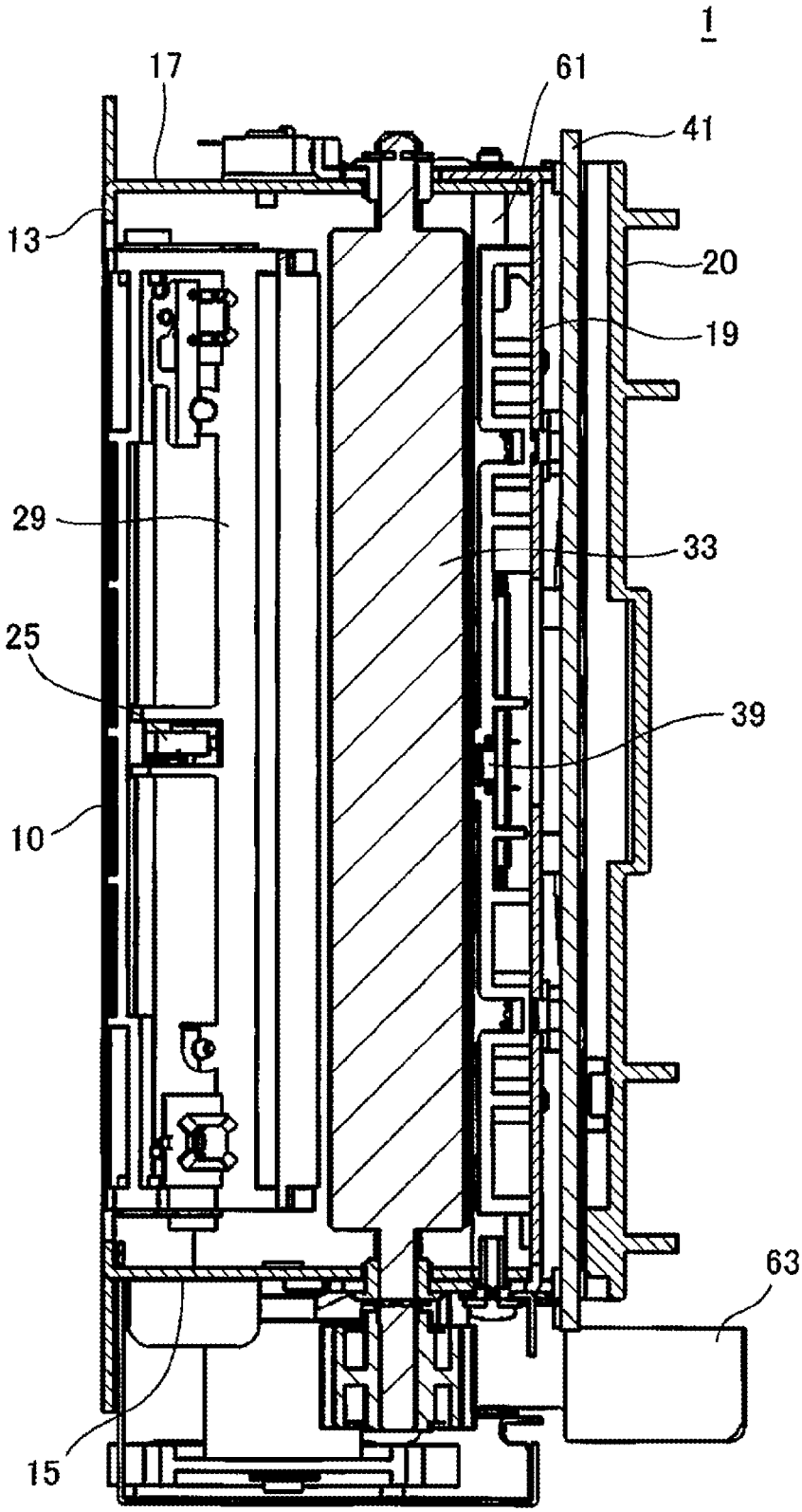
FIG. 4 is a cross-sectional view taken along line X-X' in FIG. 2.

FIG. 4 is a cross-sectional view taken along line X-X' in FIG. 2.

FIG. 4 shows a section passing through the platen 35 when viewed from bottom, where a vertical direction corresponds to a width direction of the body 10.

The jam detecting sensor 39 is located around the center in the longitudinal direction of the platen 35, that is, the width direction of the body 10. The printer 1 may use heat-sensitive roll papers S having different width sizes (for example, 80 mm-wide and 60 mm-wide), although a usable size depends on use and purpose of an apparatus accommodating the printer 1. For the purpose of stable conveyance, a heat sensitive roll paper S which is narrower than half of the platen 35 cannot be typically used. Accordingly, as shown in FIG. 4, by locating the jam detecting sensor 39 around the center in the width direction of the platen 35, a heat-sensitive roll paper S having any size used cannot pass a position which is completely out of the jam detecting sensor 39. Accordingly, even if any heat-sensitive roll paper S having any usable size is used, it can be reliably detected if a jam occurs and the heat-sensitive roll paper S gets drawn into the platen 35. In addition, for the same reason, the paper detecting sensor 25 is located around the center in the width direction of the platen 35, and, even if any heat-sensitive roll paper S having any usable size is used, the heat-sensitive roll paper S inserted through the insertion slot 23 can be reliably detected.

In addition, as shown in FIGS. 2 and 3, a control board 7 on which various kinds of circuits constituting a control system of the printer 1 is accommodated in the lower portion of the body 10.

Figure 5:
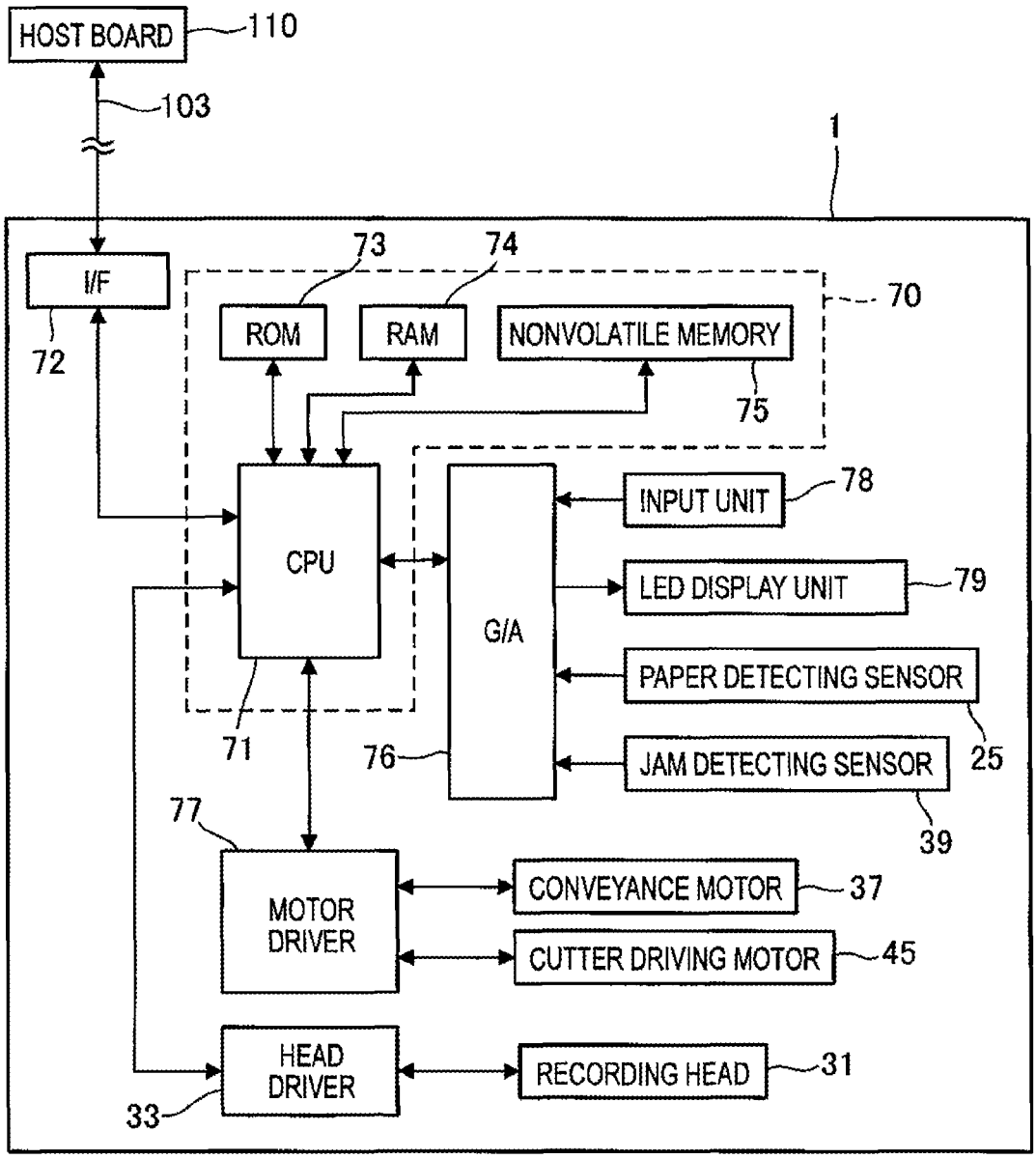
FIG. 5 is a functional block diagram showing a configuration of a control system of a printer.

Hereinafter, the control system of the printer 1 mounted on the control board 7 will be described, FIG. 5 is a block diagram showing a configuration of the control system of the printer 1.

The printer 1 includes a controller 70 which controls various components of the printer 1 to perform a print operation. The controller 70 includes a CPU 71 which executes a predetermined program to process various types of data, a ROM 73 which stores a basic control program executed by the CPU 71, a RAM 74 which forms a work area which temporarily stores a program executed by the CPU 71, data to be processed, etc., and a nonvolatile memory 75 which stores a program executed by the CPU 71, data to be processes, setting values, etc.

In addition, the printer 1 includes a gate array (G/A) 76 which converts an analog signal input from each sensor or input unit into a digital signal to be output to the CPU 71 and turns an LED on/off based on a control signal input from the CPU 71, a motor driver 77 which drives a motor or the like under control of the CPU 71, and a head driver circuit 33 which drives the recording head 31 under control of the CPU 71. The gate array 76, the motor driver 77 and the head driver circuit 33 are connected to the CPU 71 of the controller 70.

In addition, the CPU 71 is connected with an interface (I/F) 72 connected, via a flexible cable 103, to a host board 110 constituting a controller of an apparatus accommodating the printer 1. The interface 72 includes a connector or the like which connects to the flexible cable 103, and makes communication interfacing between the host board 110 and the CPU 71. Specifically, the interface 72 receives a print instructing command, print data and so on transmitted from the host board 110, outputs them to CPU 71. Further, when a command such as a status request or the like is transmitted from the host board 110, the interface 72 receives the command, outputs it to the CPU 71 and transmits a response output by the CPU 71 based on the command to the host board 110.

The gate array 76 is connected with an input unit 78 which includes various kinds of switches and outputs manipulation signals in response to manipulation of these switches, an LED display unit 79 which is composed of one or more LEDs, and the paper detecting sensor 25 and the jam detecting sensor 39 which are configured as the above-described reflective optical sensors.

The gate array 76 detects a manipulation signal output from the input unit 78 and values of detection voltages output from the paper detecting sensor 25 and the jam detecting sensor 39 based on an amount of received light, quantizes such analog values, and converts the quantized values into digital data, and output the digital data to the CPU 71. The CPU 71 detects the manipulation in the input unit 78 based on the data input from the gate array 76 and determines a detection state of the heat-sensitive roll paper S by the paper detecting sensor 25 and the jam detecting sensor 39 based on the detection voltages output from these sensors.

The conveyance motor 37 and the cutter driving motor 45 are connected to the motor driver 77. The motor driver 77 supplies driving power and output a required number of driving pulses to the cutter driving motor 45 and the conveyance motor 37, each of which is, for example, a stepping motor, so that the movable blade 43 can be moved to cut the heat-sensitive roll paper S and the conveyance motor 37 can be driven to rotate the platen 35 forwards or backwards.

In addition, the head driver circuit 33 integrated with the recording head 31 as described above supplies a driving current to each heating element (not shown) of the recording head 31 individually while controlling a voltage so that the recording head 31 can perform a print operation for the heat-sensitive roll paper S.

The CPU 71 performs a print job input from the host board 110 via the interface 72 while monitoring the present or absence of the heat-sensitive roll paper S based on the detection state of the heat-sensitive roll paper S by the paper detecting sensor 25, and drives the recording head 31 to print the heat-sensitive roll paper S through the head driver circuit 33 while driving the conveyance motor 37 to convey the heat-sensitive roll paper S through the motor driver 77. The CPU 71 drives the conveyance motor 37 to convey the printed heat-sensitive roll paper S to the cutter unit 47 and drives the cutter driving motor 45 through the motor driver 77 to allow the heat-sensitive roll paper S to be cut. In addition, upon detecting a manipulation of a switch of the input unit 78 for maintenance or the like, the CPU 71 changes a lighting state of each LED of the LED display unit 79 through the gate array 76.

If a jam occurs as the heat-sensitive roll paper S gets drawn into the platen 35 with the rotation of the platen 35, the printer 1 has the ability to detect and resolve the jam by rotate the plant 35 forwards and backwards.

As shown in FIG. 2, the jam detecting sensor 39 is disposed to face the circumference of the platen 35 above the conveyance path P and the controller 70 detects the presence or absence of the heat-sensitive roll paper S got drawn into the platen 35 by means of the jam detecting sensor 39. Upon detecting jam, the controller 70 stops the conveyance motor 37 and then rotates the conveyance motor 37 backwards. Accordingly, the conveyance motor 37 begins to rotate backwards and accordingly the heat-sensitive roll paper S got drawn into the platen 35 is returned to the conveyance path P. Thereafter, as the controller 70 rotates the conveyance motor 37 forwards again and then rotates the platen 35 forwards, the heat-sensitive roll paper S is again conveyed to the discharge port 11, thereby resolving the jam.

If the jam detecting sensor 39 still detects the jam (i.e., the paper) even with a plurality of repeated backward and forward rotations of the conveyance motor 37, it is determined that the jam cannot be resolved and a user is notified of an error by changing the lighting state of each LED of the LED display unit 79. Such a notification may be made by a warning call output from a warning call output means such as a buzzer (not shown) or the like. In this case, the number of backward and forward rotations of the conveyance motor 37 is preset and stored in the nonvolatile memory 75.

The motor driver 77 rotates the conveyance motor 37 forwards with at least two steps, preferably three steps of speed under control of the controller 70. That is, controller 70 controls the motor driver 77 to drive the conveyance motor 37 to alternate between a normal conveyance speed when the heat-sensitive roll paper S is conveyed without performing a print operation by the recording head 31, a print-for-conveyance speed when the heat-sensitive roll paper S is conveyed while performing the print operation by the recording head 31, and a jam solution-for-conveyance speed when the jam of the heat-sensitive roll paper S is resolved, which will be described later. Accordingly, the platen 35 is rotated at one of the normal conveyance speed, the print-for-conveyance speed, and the jam solution-for-conveyance speed of the conveyance motor 37 to convey the heat-sensitive roll paper S. The normal conveyance speed is the highest, the print-for-conveyance speed is medium, and the jam solution-for-conveyance speed is the lowest. The normal conveyance speed is a conveyance speed only for conveyance of the heat-sensitive roll paper S and is preferably highest for fast throughput. The print-for-conveyance speed is lower than the normal conveyance speed since the former need be limited to a speed at which the recording head 31 applies heat to the heat-sensitive roll paper S in order to keep print quality in a certain level or more. The jam solution-for-conveyance speed is especially low since the heat-sensitive roll paper S is conveyed after the jam of the heat-sensitive roll paper S is resolved, in order to prevent a recurrence of jam.

In addition, a conveyance speed when the conveyance motor 37 is rotated backwards may have one or two or more steps. This embodiment employs one step of speed. The conveyance speed during this backward rotation is preferably the same as or lower than the print-for-conveyance speed or the jam solution-for-conveyance speed. This is because the solution of jam of the heat-sensitive roll paper S ensures prevention of the heat-sensitive roll paper S from being damaged.

Figure 6:
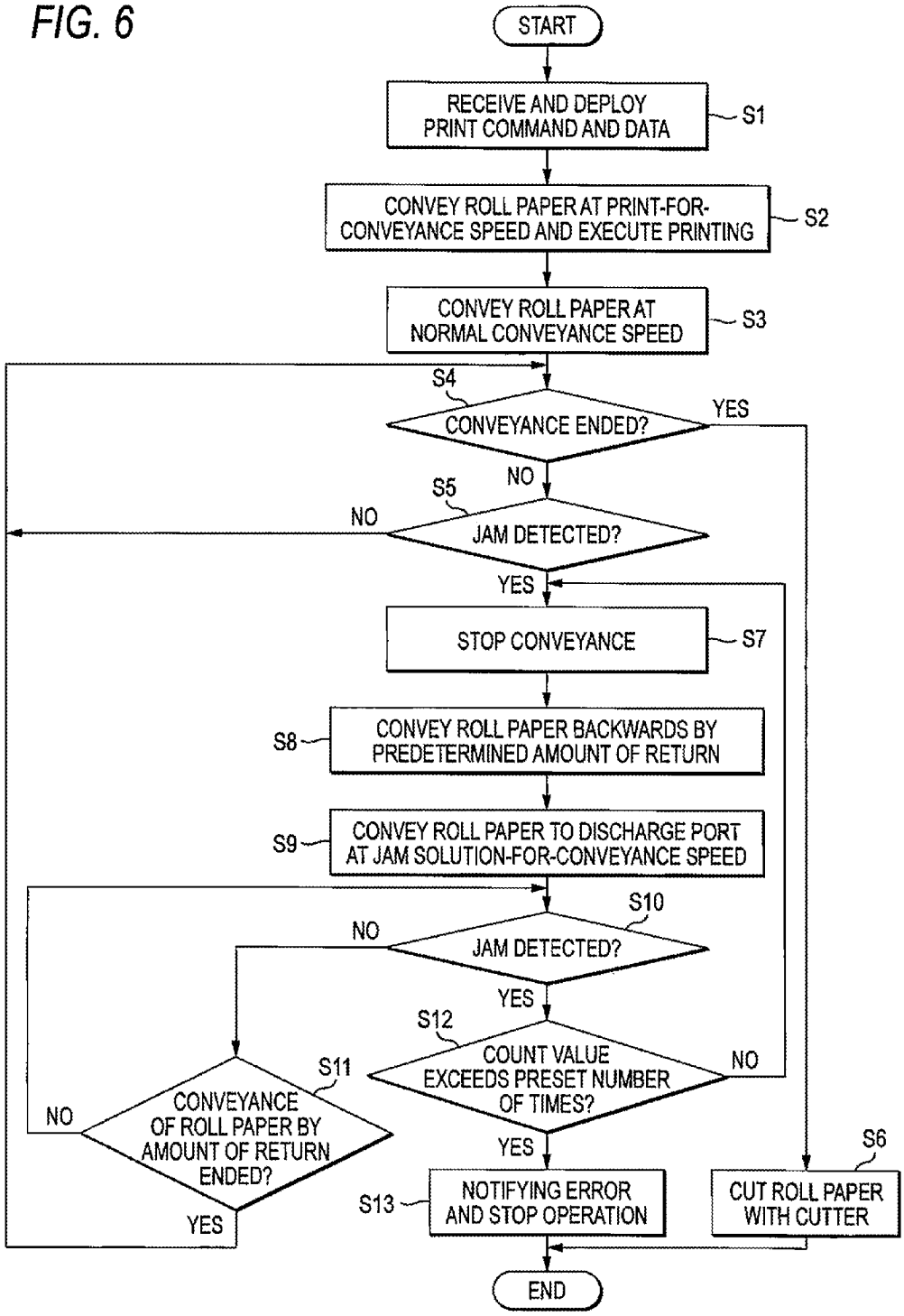
FIG. 6 is a flow chart showing a process of a printer.

FIG. 6 is a flow chart showing a process of the printer 1.

In the process shown in FIG. 6, the controller 70 receives a print instructing command and print data transmitted from the host substrate 110 via the interface 72, deploys them in a work area of the RAM 74 (Step S1), and executes the print instructing command (Step S2). At Step S2, the controller 70 rotates the conveyance motor 37 at the print-for-conveyance speed and performs a print operation for the heat-sensitive roll paper S through the recording head 31. After completion of the print operation, the controller 70 switches the rotation speed of the conveyance motor 37, i.e., the rotation speed of the platen 35, to the normal conveyance speed at which the platen 35 is rotated, and starts conveyance of the heat-sensitive roll paper S to the discharge port 11 (Step S3).

After the start of conveyance, the controller 70 determines whether or not the conveyance of the heat-sensitive roll paper S is ended (Step S4). If the conveyance of the heat-sensitive roll paper S is not ended (No in Step S4), the controller 70 determines whether or not the jam detecting sensor 39 detects the heat-sensitive roll paper S based on the detection voltage of the jam detecting sensor 39 (Step S5).

If the jam detecting sensor 39 does not detect the heat-sensitive roll paper S, the process returns to Step S4 where the conveyance continues. If the conveyance is ended (Yes in Step S4), the heat-sensitive roll paper S is cut by the cuter unit 47 (Step S6) and then the process is ended.

On the other hand, if the jam detecting sensor 39 detects the heat-sensitive roll paper S (Yes in Step S5), the controller 70 stops the conveyance motor 37 (Step S7) and rotates the conveyance motor 37 backwards in order to convey the heat-sensitive roll paper S backwards by a preset amount of return (Step S8). The amount of return is preset to be sufficient to resolve a jam, as will be described later. The preset amount of return may correspond to the number of steps of operation of the conveyance motor 37, a length of the heat-sensitive roll paper S to be conveyed, etc., which is stored in the nonvolatile memory 75.

The controller 70 has the ability to count the number of times of backward conveyance and store a count value in the RAM 74 and increments the count value by one whenever the heat-sensitive roll paper S is conveyed backwards in Step S8.

Subsequently, the controller 70 rotates the conveyance motor 37 forwards and conveys the heat-sensitive roll paper S to the discharge port 11 again (Step S9). In this conveyance, the controller 70 rotates the conveyance motor 37 at the jam solution-for-conveyance speed and conveys the heat-sensitive roll paper S by the amount of return by which the heat-sensitive roll paper S is conveyed backwards in Step S8. During this conveyance, the controller 70 monitors a detection state of the jam detecting sensor 39 (Step S10). If the jam detecting sensor 39 does not detect the heat-sensitive roll paper S (No in Step S10), the conveyance and the monitoring continue until the conveyance equivalent to the amount of return is ended (Step S11).

If the conveyance equivalent to the amount of return is ended without the heat-sensitive roll paper S being detected by the jam detecting sensor 39 (Yes in Step S11), the controller 70 clears a count value of the number of times of backward conveyance stored in the RAM 74 and then the process returns to Step S4 where the conveyance continues. In this case, at the point of time when the conveyance equivalent to the amount of return, the controller 70 switches the rotation speed of the conveyance motor 37 from the jam solution-for-conveyance speed to the normal conveyance speed at which the heat-sensitive roll paper S is conveyed until predetermined position of the heat-sensitive roll paper S reaches a cutting position of the cutter unit 47. If the conveyance is ended (Yes in Step S4), the controller 70 proceeds to Step S6 where the heat-sensitive roll paper S is cut by the cuter unit 47 and then the process is ended.

If the heat-sensitive roll paper S is detected by the jam detecting sensor 39 until the conveyance equivalent to the amount of return is ended (Yes in Step S10), the controller 70 determines whether or not the count value of the number of times of backward conveyance exceeds the preset number of times stored in the nonvolatile memory 75 (Step S12). If the count value of the number of times of backward conveyance exceeds the preset number of times (Yes in Step S12), since even the repetition of Steps S7 to S9 cannot resolve the jam, the controller 70 notifies an error and stops operation of various components including the conveyance motor 37 (Step S13) and then the process is ended. Examples of a method of indicating the error may include a method of reporting a status notifying the error to the host board 10 through the interface 72, a method of lighting the LED display unit 79 on or off, a method of outputting a beep or the like, etc.

If the count value of the number of times of backward conveyance does not exceed the preset number of times (No in Step S12), the controller 70 returns to Step S7, stops the conveyance motor 37 and again conveys the heat-sensitive roll paper S backwards.

Figure 7:
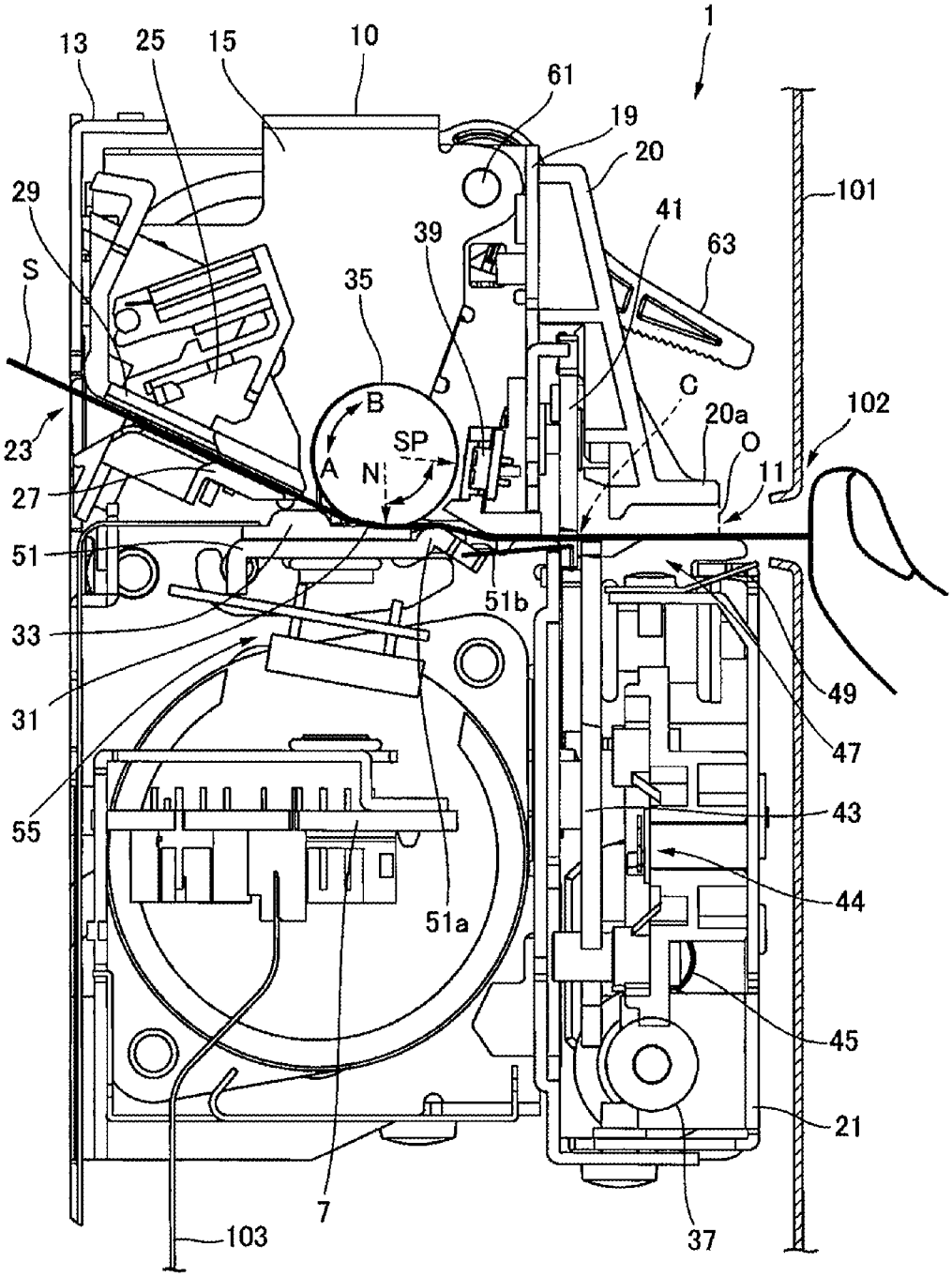
FIG. 7 is an explanatory view showing a process of detecting jamming of a heat-sensitive roll paper.
Figure 8:
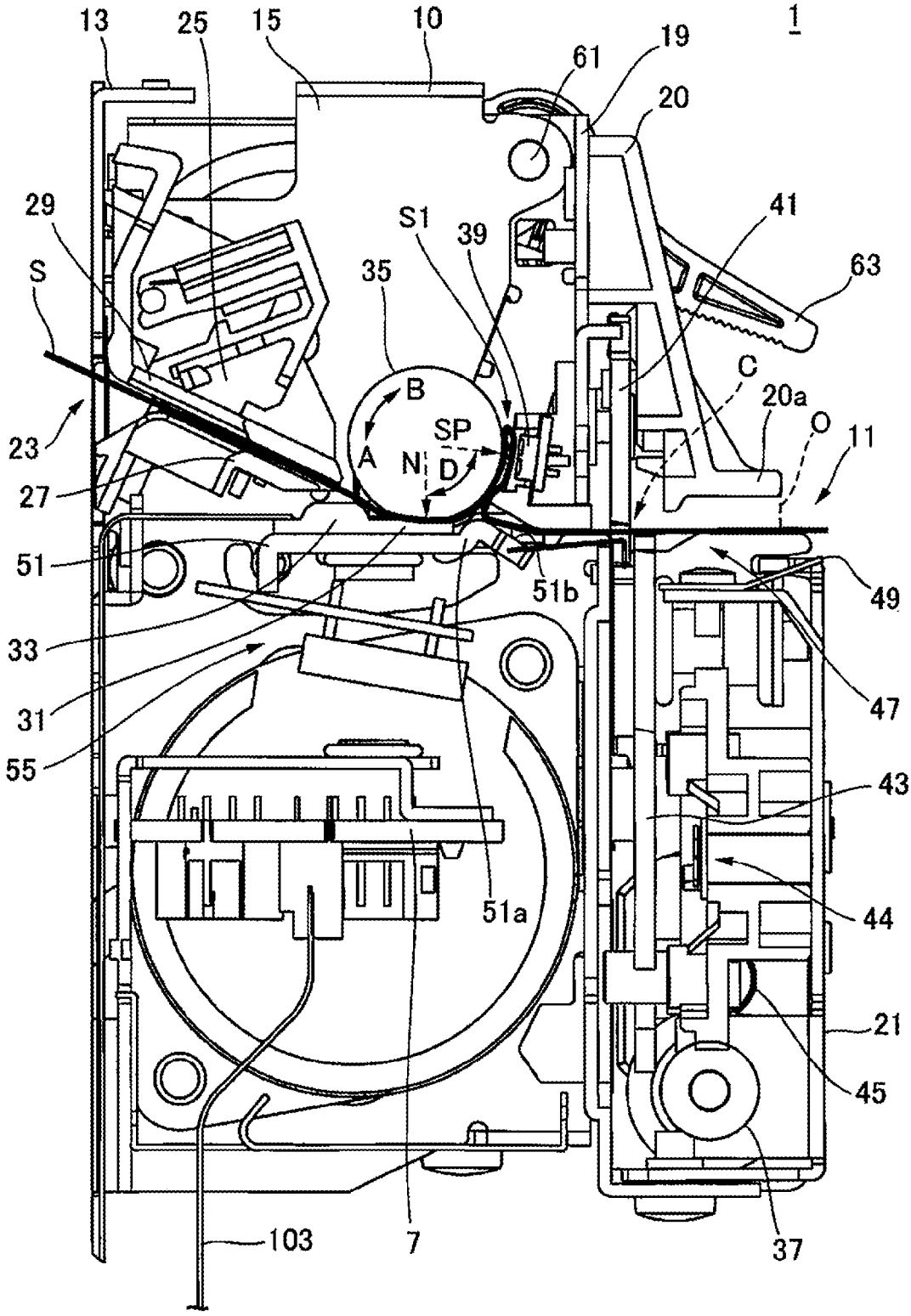
FIG. 8 is an explanatory view showing a process of detecting jamming of a heat-sensitive roll paper.
Figure 9:
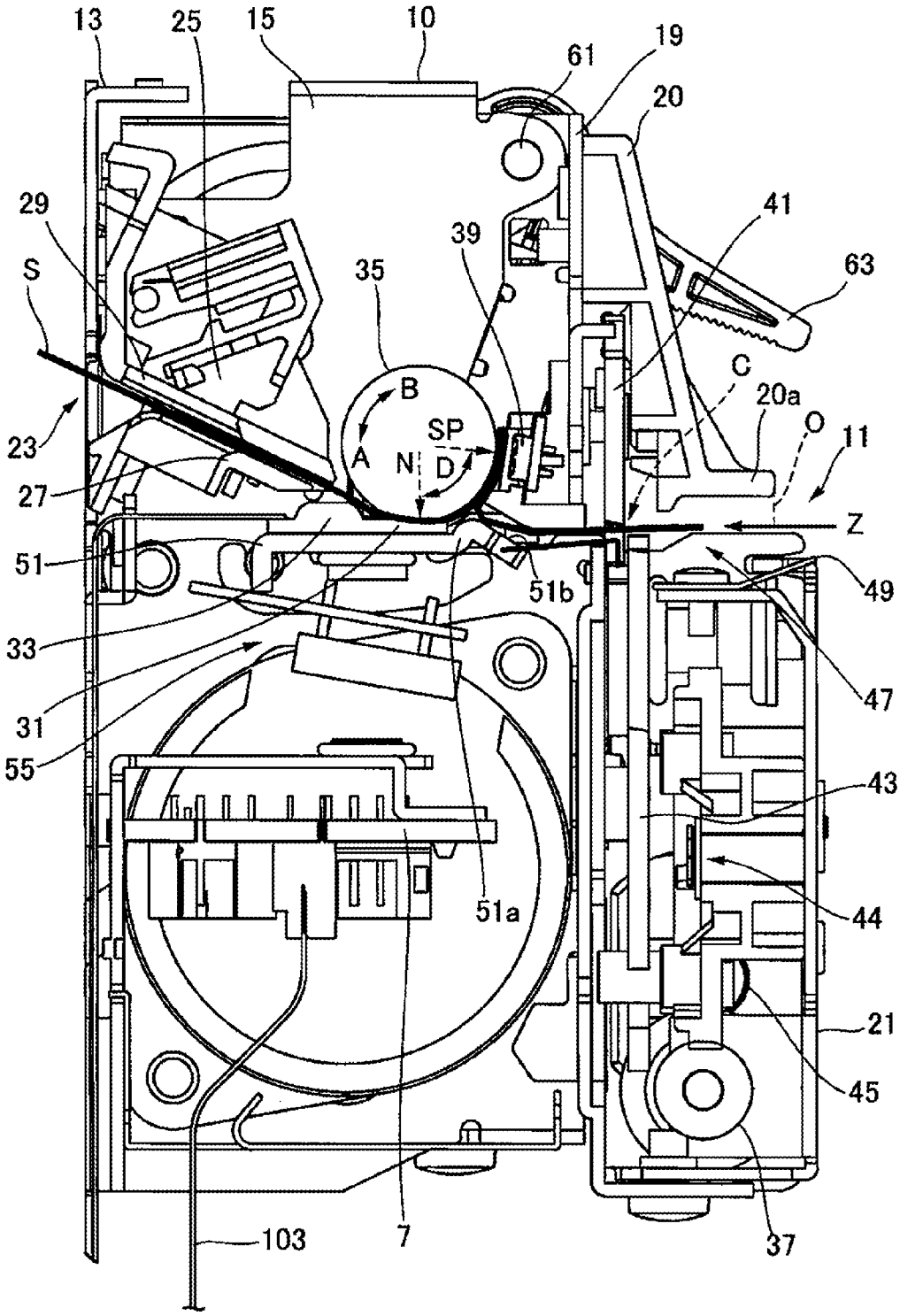
FIG. 9 is an explanatory view showing a process of detecting jamming of a heat-sensitive roll paper.

FIGS. 7 to 9 are explanatory views showing a process of detecting jamming.

FIG. 7 shows a case where the outlet 102 is clogged by a user's finger or the like, which is a typical example of generating a jam. In this case, although the printer 1 cannot discharges the heat-sensitive roll paper S, since the platen 35 is rotated forwards in the indicated by the arrow A to convey the heat-sensitive roll paper S, the heat-sensitive roll paper S is loosened. This loosening occurs in a range of from the nip N between the platen 35 and the recording head 31 to the discharge port 11 and is particularly likely to occur at a position of the projection 51*a* at which the conveyance path P is curved. This is because the heat-sensitive roll paper S is folded when it goes over the projection 51*a* and a jam occurs to expand such folding.

When the platen 35 is rotated forwards in the arrow indicated by the arrow A after the heat-sensitive roll paper S is folded in the projection 51*a*, the folded portion of the heat-sensitive roll paper S is expanded as the heat-sensitive roll paper S continues to be sent out of the nip N. As a result, as shown in FIG. 8, a loosened portion 51 of the heat-sensitive roll paper S is expanded enough to contact the circumference of the rotating platen 35 and then the heat-sensitive roll paper S gets drawn along the circumference of the platen 35.

As shown in FIG. 8, until the loosened portion S1 contacts the circumference of the platen 35, the loosened portion S1 is formed in the heat-sensitive roll paper S continuing to be forwarded from the nip N by the platen 35.

After the loosened portion S1 is drawn into the platen 35, the loosened portion S1 is folded into two sides; one connected to the heat-sensitive roll paper S above the nip N and another connected to the heat-sensitive roll paper S below the projection 51*a*. Accordingly, when the platen 35 is rotated, as both of the heat-sensitive roll paper S above the apex of the loosened portion S1 and the heat-sensitive roll paper S below the apex of the loosened portion S1 get drawn into the platen 35, the heat-sensitive roll paper S below the projection 51*a* is pulled in a direction indicated by an arrow Z in FIG. 9. In this manner, since a jam is unlikely to occur at other place on the conveyance path P, the heat-sensitive roll paper S gets folded without escaping and is returned to the conveyance path P by the backward rotation of the platen 35, which facilitates removal of a jam.

When the loosened portion S1 drawn into the platen 35 arrives at a detection position SP of the jam detecting sensor 39, the controller 70 detects a jam of the heat-sensitive roll paper S based on the detection state of the jam detecting sensor 39. The controller 70 releases the loosened portion S1 by stopping the platen 35 and then rotating it backwards.

As shown in FIGS. 7 to 9, the jam detecting sensor 39 is disposed at a position at which a length D extending from the nip N to the detection position SP along the circumference of the platen 35 is shorter than a length extending from the projection 51*a* where the loosened portion S1 is produced to a position O of the discharge port 11.

As described above, after the loosened portion S1 is drawn into the platen 35, the heat-sensitive roll paper S between the projection 51*a* and the discharge port 11 is pulled into the body 10. When a leading end of the heat-sensitive roll paper S below the projection 51*a* is drawn into the platen 35, even if the loosened portion S1 is released by the backward conveyance and forward rotation by the platen 35, the released heat-sensitive roll paper S is likely to not well proceed below the projection 51*a*. If the leading end of the heat-sensitive roll paper S deviates from the conveyance path P, then even when the platen 35 is backwards and forwards rotated, it is difficult for the leading end of the heat-sensitive roll paper S to proceed to the discharge port 11 along the conveyance path P. However, in this embodiment, since the leading end of the heat-sensitive roll paper S stays on the conveyance path without deviating from the conveyance path P, the leading end of the heat-sensitive roll paper S can smoothly proceed to the discharge port 11 along the conveyance path P even when the platen 35 is rotated backwards and forwards.

Accordingly, in this embodiment, by making the length D from the nip N to the detection position SP shorter than the length from the projection 51*a* to the position O, the printer 1 is configured to allow the jam detecting sensor 39 to detect the heat-sensitive roll paper S before the leading end of the heat-sensitive roll paper S below the projection 51*a* is drawn into the platen 35. With this configuration, when the loosened portion S1 is released by the backward conveyance and forward rotation of the platen 35, the heat-sensitive roll paper S can be reliably conveyed to the discharge port 11.

Immediately after the heat-sensitive roll paper S is cut by the cutter unit 47, the leading end of the heat-sensitive roll paper S is at a cutting position C of the cutter unit 47. In this case, in order to release the loosened portion S1 to reliably convey the heat-sensitive roll paper S to the discharge port 11, the jam detecting sensor 39 may be provided to make the length D shorter than a distance from the projection 51*a* to the cutting position C. In this case, since the leading end of the heat-sensitive roll paper S is below the projection 51*a* at the point of time when the jam detecting sensor 39 detects the loosened portion S1, the heat-sensitive roll paper S can be again conveyed to the discharge port 11 by releasing the loosened portion S1 by the backward conveyance and forward rotation of the platen 35 even immediately after the cutter unit 47 cuts the heat-sensitive roll paper S.

In addition, it is more preferable that the length D from the nip N to the detection position SP along the circumference of the platen 35 is shorter than a distance from the cutting position C of the cutter unit 47 to the position O of the discharge port 11.

Figure 10:
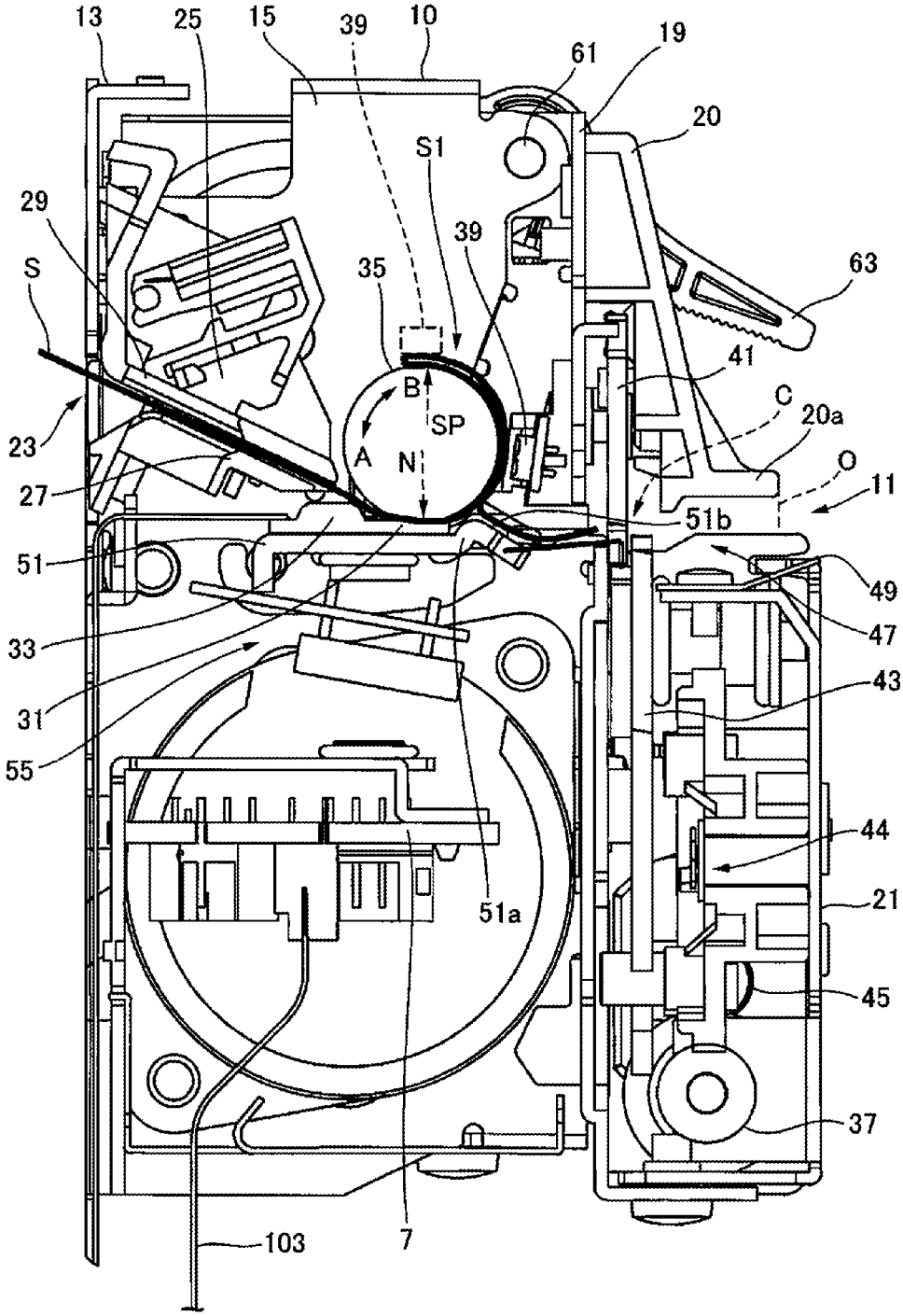
FIG. 10 is a view showing different examples of installation of a jam detection sensor.

For example, as shown by an imaginary line in FIG. 10, if the jam detecting sensor 39 is placed at a position at which the length D from the nip N to the detection position SP is expanded, at the point of time when the jam detecting sensor 39 detects the loosened portion S1, the heat-sensitive roll paper S below the projection 51*a* is wound on the platen 35 and the leading end of the heat-sensitive roll paper S arrives above the cutting position C. In this state, when the platen 35 is rotated backwards and forwards to release the loosened portion S1, it cannot be denied that the leading end of the heat-sensitive roll paper S may be caught by the fixed blade 41 or the movable blade 43.

In order to exclude this possibility, the leading end of the heat-sensitive roll paper S may be placed below the cutting position C at the point of time when the jam detecting sensor 39 detects the loosened portion S1. That is, assuming that a distance from the projection 51*a* to the cutting position C is D1 and a distance from the projection 51*a* to the position O of the discharge port 11 is D2, the length D from the nip N to the detection position SP is D D2−D1. D2−D1 is a distance from the cutting position C to the position O of the discharge port 11. That is, it can be said that the length D is preferably equal to or less than a distance from the cutting position C to the position O of the discharge port 11.

In addition, in order to release the loosened portion S1, the "amount of return" for the backward conveyance after the controller 70 detects a jam through the jam detecting sensor 39 is preferably equivalent to or equal to or more than at least the length D from the nip N to the detection position SP. More preferably, the amount of return corresponds to an addition of 10 operation steps of the conveyance motor 37 to the length D.

Although a more amount of return may release the loosened portion S1 more reliably, if the amount of return is too large, the leading end of the heat-sensitive roll paper S may be moved above the nip N or the projection 51*a* when the backward conveyance is ended. Accordingly, the upper limit of the amount of return is set such that the leading end of the heat-sensitive roll paper S is located below the nip N or the projection 51*a* when the backward conveyance is ended.

As described above, the embodiment of the present invention provides the printer 1 which conveys the heat-sensitive roll paper S, records an image on the heat-sensitive roll paper S and discharges the heat-sensitive roll paper S with the image recorded thereon from the discharge port 11, including the platen 35 which conveys the heat-sensitive roll paper S, the conveyance path P which has a curved portion curved by the projection 51*a* below the nip of the platen 35, the jam detecting sensor 39 which is located off the conveyance path P of the heat-sensitive roll paper S and detects the heat-sensitive roll paper S which deviates from the conveyance path P at the curved portion of the conveyance path P, and the controller 70 which rotates the platen 35 backwards to convey the heat-sensitive roll paper S backwards when the heat-sensitive roll paper S is detected by the jam detecting sensor 39, and then rotates the platen 35 forwards by at least an amount of backward conveyance to convey the heat-sensitive roll paper S to the discharge port 11.

With this configuration, if a jam occurs in the curved portion while the heat-sensitive roll paper S is conveyed to the conveyance path P having the curved portion, the jam is quickly detected by detecting the heat-sensitive roll paper S which deviates from the conveyance path P through the jam detecting sensor 39 and the jam of the heat-sensitive roll paper S is resolved by rotating the platen 35 first backwards and then forwards. Accordingly, the jam can be resolved with no manual work by quickly detecting the jam of the heat-sensitive roll paper S. As a result, it is possible to minimize a possibility of stoppage of apparatus and the printer 1 and an apparatus incorporating the printer 1 due to a jam of the heat-sensitive roll paper S and make stoppage time as short as possible, which may result in reduced work burden and costs for maintenance and improved availability of the apparatus.

In addition, as the printer 1 is disposed inside the exterior panel 101 and the heat-sensitive roll paper S is discharged through the outlet 102 of the exterior panel 101 located outside the discharge port 11, if the conveyance of the heat-sensitive roll paper S at the outlet 102 of the exterior panel 101 is disturbed so that a jam is generated, the jam can be quickly detected to resolve the jam by the backward and forward rotation of the platen 35.

In addition, since the jam detecting sensor 39 is disposed to detect the heat-sensitive roll paper S at a position facing the circumference of the platen 35 and the distance from the nip N of the platen 35 to the detection position of the jam detecting sensor 39 is shorter than the distance from the projection 51*a* to the discharge port 11, the heat-sensitive roll paper S curved in the curved portion of the conveyance path P by the projection 51*a* and drawn into the platen 35 can be detected by the jam detecting sensor 39. In addition, since the jam can be detected before the entire heat-sensitive roll paper S conveyed below the projection 51*a* gets drawn into the platen 35, the jam can be efficiently resolved by the operation of the platen 35 after the detection.

In addition, the jam can be resolved without manual work by the operation of the platen 35 which is disposed to face the recording head 31 and conveys the heat-sensitive roll paper S with the heat-sensitive roll paper S interposed therebetween.

In the printer 1, since the platen 35 can be deviated from a normal position facing the recording head 31 to the discharge port 11, the projection 51*a* projecting toward the conveyance path P is provided to include the inclined plane 51*b* which smoothly guides the platen 35 after contacting the platen 35 such that the platen 35 does not collide with the recording head 31 while the platen 35 is returned from its deviation position to its normal position, and the heat-sensitive roll paper S is conveyed over the projection 51*a*, it is possible to quickly detect and resolve a jam which may occur as the heat-sensitive roll paper S is folded when the heat-sensitive roll paper S passes beyond the projection 51*a*. In addition, as the platen 35 is moved with deviation and the conveyance path P through which the heat-sensitive roll paper S passes is opened, it is possible to facilitate setting of the heat-sensitive roll paper S and remove the heat-sensitive roll paper S easily with a jam unresolved. In addition, the projection 51*a* can be configured to integrate the inclined plane 51*b* guiding the platen 35 with the curved portion which may serve as the cause of jam, which is effective for compactness of the apparatus.

In addition, since the controller 70 of the printer 1 rotates the platen 35 backwards as the heat-sensitive roll paper S is detected by the jam detecting sensor 39, and then conveys the heat-sensitive roll paper S to the discharge port 11 at the jam solution-for-conveyance speed which is lower than the normal conveyance speed at which the heat-sensitive roll paper S is conveyed to the discharge port 11 after normal recording is ended, a recurrence of jam is prevented to resolve the jam more reliably.

In addition, since the jam detecting sensor 39 is disposed in the center in the width direction of the platen 35, it is possible to quickly detect a jam for the heat-sensitive roll paper S having different widths.

While the embodiments of the present invention have been particularly shown and described in the above, the present invention is not limited thereto. For example, while it has been illustrated in the above embodiments that the printer 1 conveys the heat-sensitive roll paper S using one platen 35, the present invention is not limited thereto but one or more conveyance rollers in addition to the roller platen may be provided to convey the heat-sensitive roll paper S.

In this case, the jam detecting sensor 39 which detects the jam of the heat-sensitive roll paper S may be provided to face the circumference of one of the conveyance rollers and roller platen, which is closest to the discharge port 11.

In addition, for example, while it has been illustrated in the above embodiments that the heat-sensitive roll paper S is introduced from the outside of the body 10 through the insertion slot 23 for print, the present invention is not limited thereto but a container which accommodates the heat-sensitive roll paper may be provided inside the body 10.

In addition, a recording apparatus to which the spirit of the present invention can be applied is not particularly limited as long as it can convey a recording medium and record an image on the recording medium. For example, without being limited to the thermal line printer, the recording apparatus may be any of an ink jet type printer, a dot impact type printer, a laser printer and a thermal sublimation type printer. In addition, the recording apparatus may be an apparatus which forms characters and images in different ways. Further, the recording apparatus is not limited to the built-in recording apparatus of the above embodiment but may be a standalone recording apparatus having a separate exterior case, a multifunction copier having different functions, or other suitable apparatuses known in the art.

What is claimed is:

1. A recording apparatus, comprising:

a recording head that performs recording on a recording medium;

a conveyance roller that conveys the recording medium in a conveyance direction;

a conveyance path including a curved portion which guides the recording medium and curves the recording medium in a downstream of a nip portion between the recording head and the conveyance roller in the conveyance direction;

a discharge portion that discharges the recording medium;

a detecting unit that is located apart from the conveyance path, the detecting unit that detects the recording medium which deviates from the conveyance path as the recording medium is drawn into and along the conveyance roller near the curved portion of the conveyance path; and a controller which rotates the conveyance roller backwards by a predetermined amount to convey the recording medium backwards when the recording medium is detected by the detecting unit, and then rotates the conveyance roller forwards by at least the predetermined amount.

2. The recording apparatus as set forth in claim 1, wherein the detecting unit is disposed so as to detect the recording medium at a position facing a circumference of the conveyance roller, and wherein a distance along the circumference of the conveyance roller from the nip portion to a detection position of the detecting unit is shorter than at least a distance from the curved portion of the conveyance path to the discharge port.

3. The recording apparatus as set forth in claim 1, wherein the conveyance roller is a platen which is disposed so as to face the recording head and conveys the recording medium interposed between the platen and the recording head when performing the recording on the recording medium.

4. The recording apparatus as set forth in claim 3, wherein the recording apparatus includes a body and a front frame, wherein the front frame is rotatably attached to the body, wherein the body is provided with at least the recording head, and wherein the front frame is provided with at least the platen.

5. The recording apparatus as set forth in claim 4, wherein the platen is movable between a normal position facing the recording head and a deviation position at a side of the discharge port, wherein a projection having an inclined plane which contacts the platen and guides the platen to the normal position when the platen is moved from the deviation position to the normal position is provided at a side of the recording head, and wherein the projection projects toward the conveyance path to form the curved portion.

6. The recording apparatus as set forth in claim 1, wherein the controller rotates the conveyance roller backwards when the detecting unit detects the recording medium, and then conveys the recording medium at a speed which is lower than a speed at which the recording medium is conveyed during or after performing the recording on the recording medium.

7. The recording apparatus as set forth in claim 1, further comprising a notifying unit that notifies that the recording medium is detected when the detecting unit detects the recording unit after the controller rotates the conveyance roller backwards and forwards at least once.

8. The recording apparatus as set forth in claim 1, wherein the predetermined amount by which the conveyance roller is rotated backwards is set such that a leading end of the recording medium is located in the downstream of the nip portion or the curved portion in the conveyance direction after the conveyance roller is rotated backwards by the predetermined amount.

9. The recording apparatus as set forth in claim 1, further comprising a cutter disposed in the downstream of the recording head in the conveyance direction, the cutter that cuts the recording medium at a cutting position, wherein a distance along a circumference of the conveyance roller from the nip portion to a detection position of the detecting unit is shorter that at least a distance from the cutting position of the cutter to the discharge port.

10. The recording apparatus as set forth in claim 1, further comprising a recording head supporting unit that supports the recording head, wherein the curved portion is integrally formed in the recording head supporting portion.

11. A control method of a recording apparatus which comprises:

a recording head that performs recording on a recording medium;

a conveyance roller that conveys the recording medium in a conveyance direction;

a conveyance path including a curved portion which guides the recording medium and curves the recording medium in a downstream of a nip portion between the recording head and the conveyance roller in the conveyance direction;

a discharge portion that discharges the recording medium; and a detecting unit that is located apart from the conveyance path, the detecting unit that detects the recording medium which deviates from the conveyance path as the recording medium is drawn into and along the conveyance roller near the curved portion of the conveyance path, the control method comprising:

rotating the conveyance roller backwards by a predetermined amount to convey the recording medium backwards when the recording medium is detected by the detecting unit, and then rotating the conveyance roller forwards by at least the predetermined amount.

12. The control method as set forth in claim 11, further comprising determining that a jam is generated if the detecting unit detects the recording medium.

13. The control method as set forth in claim 12, further comprising determining that the jam is not resolved if the detecting unit detects the recording unit after rotating the conveyance roller backwards and forwards at least once.

14. The control method as set forth in claim 11, further comprising conveying the recording medium at a speed which is lower than a speed at which the recording medium is conveyed during or after performing the recording on the recording medium, when rotating the conveyance roller forwards after rotating the conveyance roller backwards as the recording medium is detected by the detecting unit.

15. The control method as set forth in claim 11, wherein the predetermined amount by which the conveyance roller is rotated backwards is set such that a leading end of the recording medium is located in the downstream of the nip portion or the curved portion in the conveyance direction after the conveyance roller is rotated backwards by the predetermined amount.

* * * * *